US009492734B2

(12) United States Patent
Boulding

(10) Patent No.: US 9,492,734 B2
(45) Date of Patent: Nov. 15, 2016

(54) MULTI-DIMENSIONAL PUZZLE

(71) Applicant: Boulding Blocks LLC, Denver, CO (US)

(72) Inventor: Mark Boulding, Englewood, CO (US)

(73) Assignee: Boulding Blocks LLC, Denver, CO (US)

( * ) Notice: Subject to any disclaimer, the term of this patent is extended or adjusted under 35 U.S.C. 154(b) by 0 days.

(21) Appl. No.: 14/685,800

(22) Filed: Apr. 14, 2015

(65) Prior Publication Data

US 2015/0290532 A1 Oct. 15, 2015

Related U.S. Application Data

(60) Provisional application No. 62/084,724, filed on Nov. 26, 2014, provisional application No. 61/979,328, filed on Apr. 14, 2014.

(51) Int. Cl.
*A63F 9/12* (2006.01)

(52) U.S. Cl.
CPC ..... *A63F 9/1208* (2013.01); *A63F 2009/1228* (2013.01)

(58) Field of Classification Search
CPC ..... A63F 9/0602; A63F 9/12; A63F 9/1208; A63F 209/1232; A63F 2009/1228; A63F 2009/1232; A63F 2009/128; A63H 33/08; A63H 33/04; A63H 33/082; A63B 33/084; A63B 33/086
See application file for complete search history.

(56) References Cited

U.S. PATENT DOCUMENTS 785,665 A 3/1905 Coe
1,518,889 A 12/1924 Wooster
2,278,327 A * 3/1942 Magnus ..... A63H 33/108 446/112
3,005,282 A 10/1961 Christiansen
3,678,613 A 7/1972 Geymeier
3,845,959 A 11/1974 Kosarek
3,919,785 A 11/1975 Generaux
4,011,683 A 3/1977 De Sousa
4,036,503 A 7/1977 Golick
4,077,154 A 3/1978 Muller
4,153,254 A 5/1979 Marc
4,308,016 A 12/1981 White
4,424,971 A 1/1984 Clark
4,469,331 A * 9/1984 Rinker ..... A63F 9/12 273/157 R
4,488,725 A 12/1984 Clark
5,082,420 A 1/1992 Patrick, Jr.
5,098,328 A * 3/1992 Beerens ..... A63H 33/086 446/125
5,169,352 A 12/1992 Petersen
5,251,900 A * 10/1993 Gallant ..... A63F 9/10 273/157 R
5,273,477 A 12/1993 Adams, Jr.

(Continued)

OTHER PUBLICATIONS

Browne, "Boche cube," retrieved from http://www.cameronius.com/games/boche/, 2008, 5 pages.

(Continued)

*Primary Examiner* — Steven Wong
(74) *Attorney, Agent, or Firm* — Sheridan Ross P.C.

(57) ABSTRACT

The invention generally relates to multi-dimensional puzzles for teaching, entertainment, and construction. One embodiment of the invention comprises two forms, one planar and one non-planar, which comprise a plurality of protrusions and recesses. These forms may be assembled by selectively interconnecting the various protrusions and recesses to create multi-dimensional shapes such as a cube, cylinder, and sphere among many other possibilities.

20 Claims, 9 Drawing Sheets

(56) References Cited

U.S. PATENT DOCUMENTS

| | | | | |
|---|---|---|---|---|
| 5,282,063 | A | 1/1994 | Deacon et al. | |
| 5,310,183 | A | 5/1994 | Glikmann | |
| 5,344,147 | A | 9/1994 | Lee | |
| 5,378,185 | A * | 1/1995 | Ban | A63H 33/08 446/120 |
| 5,393,063 | A | 2/1995 | Ichimaru | |
| 5,405,135 | A | 4/1995 | Embro | |
| 5,617,691 | A * | 4/1997 | Yamamoto | A63H 33/08 446/125 |
| 5,800,565 | A | 9/1998 | Biedermann | |
| 5,823,530 | A | 10/1998 | Yang | |
| 5,823,533 | A | 10/1998 | Edwards | |
| 5,826,873 | A * | 10/1998 | Lavermicocca | A63F 9/12 273/157 R |
| 6,050,566 | A | 4/2000 | Shameson | |
| 6,086,067 | A * | 7/2000 | Benoit | A63F 9/12 273/157 R |
| 6,273,635 | B1 | 8/2001 | Swanson | |
| 6,386,542 | B1 * | 5/2002 | Lore | A63F 9/12 273/156 |
| 6,460,850 | B1 | 10/2002 | Dodek, II | |
| 6,513,808 | B2 | 2/2003 | Fang | |
| 6,648,330 | B2 | 11/2003 | Porter | |
| 6,910,691 | B2 | 6/2005 | Shih | |
| 7,140,612 | B2 | 11/2006 | Chen | |
| 7,198,270 | B1 * | 4/2007 | Bishop | A63F 9/12 273/153 S |
| 7,644,924 | B2 | 1/2010 | Horowitz | |
| 8,272,956 | B2 | 9/2012 | Kelly et al. | |
| 8,342,527 | B2 | 1/2013 | Wu | |
| D689,558 | S | 9/2013 | Jensen | |
| 8,567,149 | B2 | 10/2013 | Kuzmin | |
| 8,628,393 | B1 | 1/2014 | Bachrach et al. | |
| 8,632,072 | B2 | 1/2014 | Loveland | |
| D741,414 | S * | 10/2015 | Lu | D21/499 |
| D748,415 | S * | 2/2016 | De Roeck | D6/675 |
| 2008/0280522 | A1 * | 11/2008 | Bishop | A63H 33/084 446/124 |
| 2010/0227675 | A1 | 9/2010 | Luxton et al. | |
| 2011/0031689 | A1 * | 2/2011 | Binder | A63F 9/1011 273/157 R |
| 2013/0115849 | A1 * | 5/2013 | Yap | A63H 9/00 446/128 |
| 2013/0154188 | A1 * | 6/2013 | Burrows | A63F 9/10 273/157 R |
| 2013/0203316 | A1 * | 8/2013 | Uno | A63H 33/086 446/124 |
| 2013/0316832 | A1 | 11/2013 | Olofsson et al. | |
| 2014/0194174 | A1 | 7/2014 | Bachrach et al. | |
| 2014/0265116 | A1 | 9/2014 | Christianson | |

OTHER PUBLICATIONS

Sirmakesalot, "Cube forms," retrieved from http://www.thingiverse.com/thing:10862, 2011, 3 pages.

Xmbrst, "Gyroid Soma Cube Puzzle," retrieved from http://www.thingiverse.com/thing:111246, 2013, 3 pages.

Van Deventer, "Hollow Cube," retrieved from http://www.shapeways.com/product/PT34TDJFU/hollow-cube, 2016, 5 pages.

Gain, "richgain Creations," retrieved from http://www.shapeways.com/designer/richgain?s=48#more-products, 2016, 9 pages.

Avarga, "XorCube," retrieved from http://www.shapeways.com/product/B77QNAEUF/xorcube, 2016, 4 pages.

* cited by examiner

MULTI-DIMENSIONAL PUZZLE

CROSS-REFERENCE TO RELATED APPLICATION

This application claims the benefit of U.S. Provisional Patent Application No. 62/084,724, filed Nov. 26, 2014 and U.S. Provisional Patent Application No. 61/979,328, filed Apr. 14, 2014, which are hereby incorporated by reference in their entireties.

FIELD

This invention relates generally to the field of multi-dimensional puzzles.

BACKGROUND

Puzzles have increased in popularity with a view toward increasing the mental challenge of solving such puzzles and the manual dexterity required for the same. There have previously been devised games and puzzles in which pieces of a predetermined shape have been movable in two or even three dimensions within an exterior housing into a variety of spatial relationships with respect to each other.

Existing puzzles include the "Rubik's Cube" which while challenging is inordinately complex both in concept and physical manufacture. On the other end of the scale with respect to shifting piece puzzles, the well-known planar array of fifteen slidable squares in a four by four matrix pattern provides a challenge that is far more readily solved than when effecting solution of a position problem in a three dimensional environment.

U.S. Pat. No. 3,845,959, which is hereby incorporated by reference in its entirety, teaches a cube puzzle which includes a plurality of cubes of a uniform size that are movable within a volume of constant thickness defined within an outer housing of the same shape as the movable cubes. In the cube puzzle, the sides of the movable cubes are colored selectively so as to provide a different colored pattern for each solution of the cube puzzle.

U.S. Pat. No. 785,665, which is hereby incorporated by reference in its entirety, teaches a puzzle apparatus which includes a playing board divided into variously-colored spaces and a set of movable playing pieces arranged upon the playing-board. The number of the playing pieces is one less than the number of spaces upon the playing board. Each playing piece has a color corresponding to the color of a space upon the board. Each playing piece is provided with an opening through which the color of the space over which the playing-piece is moved will be exposed.

U.S. Pat. No. 4,036,503, which is hereby incorporated by reference in its entirety, teaches a cube puzzle in which the cubes may be rotated, as well as slid from an occupied space into an adjacent space. In this cube puzzle the cubes are slid or rotated within the container by manipulating the container itself, such as by rotating, tilting, twisting or tapping on the container.

U.S. Pat. No. 4,424,971, which is hereby incorporated by reference in its entirety, teaches a manipulative cube puzzle which includes a cube-shaped container and a plurality of cubes. The manipulative cube puzzle has at least one horizontal tier of cubes in which the cubes may be slid, rotated or tumbled at the option of the player. The cubes are marked on at least part of the faces with various colors, letters, numbers, designs or symbols in order to permit the player to arrange the cubes in combinations of varying complexity.

U.S. Pat. No. 4,488,725, which is hereby incorporated by reference in its entirety, teaches a cube puzzle in which a container is divisible into a given number of spaces and filled with one less cube than the number which would be required to till the container. The space, which is not occupied by a cube, provides a space into which an adjacent cube may be slid, which in turn creates a space having a different location in the container. Initially, the cubes are placed either at random or jumbled. The object of the game is to manipulate the cubes to a position which will spell words, or to arrange the cubes in a numerical sequence.

U.S. Pat. No. 1,518,889, which is hereby incorporated by reference in its entirety, is an example of a two tier puzzle in which the faces of the individual cubes are printed or impressed with letters and numerals. The cubes must be arranged in such a manner that it is possible to spell certain words and make certain numerical arrangements. The invention relates to a system of form bodies for use as toy building blocks, decorative objects, in particular for display use, furniture structures, sculptural building components etc., in which each form has the shape of a polyhedron, in which polygonal side faces with each other form polyhedral outward extending protuberances and/or polyhedral inward extending recesses for assembling differently shaped bodies into spatial structures. Other potentially relevant references include U.S. Patent Publication Nos. 2014/0265116, 2014/0194174 and U.S. Pat. No. 8,628,393; which are hereby incorporated by reference in their entirety.

While the prior art includes puzzles that are multi-dimensional, these puzzles are largely self-contained apparatuses and/or have simply-shaped components.

SUMMARY

The invention is directed to a novel multi-dimensional puzzle for education, entertainment, and construction. In some embodiments, the puzzle that can be used to increase and expand individual and group thinking skills, problem solving skills, and decision-making experiences.

It is another aspect of embodiments of the invention to provide rehabilitation, both physically and mentally. Accidents, diseases, and simple aging can reduce the physical and mental faculties of an individual. Embodiments of the invention can be used in mental rehabilitation and physical rehabilitation to strengthen body parts, such fingers that have become weakened or stiff.

It is a further aspect of embodiments of the invention to provide a puzzle that aids the mental and physical development of children. This invention may reside in an educational toy, teaching device and puzzle block combination which is useful in developing a child's perception of volume and proportion. The invention, however, may also serve simply as a toy to be played with by "children" of all ages. Adults may find the invention to constitute a most interesting puzzle to solve. The invention can comprise a number of graphic blocks of varying but related sizes so designed as to define, in proper combination, one or more patterns located in one or more planes.

An aspect of embodiments of this invention is to provide a puzzle for assembling the desired three dimensional structures which excites a user's interest greatly and furthers the development of the user's imagination. A further aspect of embodiments of this invention is to provide a new cube puzzle for assembling the desired structures which can be played by those including a child, a grandfather and a grandmother.

Another aspect of embodiments of this invention is to provide a new cube puzzle whereby a desired three dimensional structure can be erected. Other embodiments of the invention may provide a puzzle whereby the desired plane characters such as animals, bipeds or flowers can be assembled. Another objective of the invention is to provide an improved cubic puzzle which is able to be disassembled and reassembled after rotation so that designated patterns on elementary pieces are able to be matched with other identical patterns to form pictures.

An aspect of embodiments of the invention is to provide a puzzle whereby a game can be played by multiple players, allowing players to assemble the desired structures, to play a booking seat game or to play a changing game of the assembled patterns. The game can be played joyously by a plurality of players by selecting the cube puzzles. The games may be organized into races to assemble a puzzle or puzzles in the shortest amount of time. For example, each participant in a puzzle race may start with a pile of components from several different puzzles, and the participant must solve all puzzles.

It is another aspect of embodiments of the invention to provide a puzzle whereby letters may comprise the components of the puzzle. For example, the components of a puzzle could be blocks letters such as "E" or "F". In a given puzzle, a user may be given a number of letters and the user must combine the letters in a singular or open-ended goal, similar to the board game Scrabble.

A further aspect of embodiments of the invention is to provide a new cube puzzle with which a player can play with the difficulty of a game by changing a number of the forms to be assembled. Another aspect of this invention is to provide a puzzle whereby an overall assembled puzzle cannot be seen through readily by the other players.

It is yet another aspect of embodiments of the invention to provide a puzzle that demonstrates, in a mathematically elegant way, the concept of positive and negative space in a structural system. Polyhedral bricks made of solid substance represent the "on" or "1" of digital information, while the clear polyhedral bricks represent the "off" or "0" of same. In another sense, the puzzle demonstrates the idea of "is" and "is not" and the principle that what "is" defines what is not, and what "is not" defines what "is".

In certain embodiments of the invention, the puzzle is comprised of one solid (opaque) shape duplicated eight times and one void (clear) shape also duplicated eight times. Either shape can be clear or opaque. Sixteen pieces may selectively interconnect to create a cube with an equal number of solid (opaque) shapes and void (clear) shapes. In other embodiments, there are an unequal number of solid and void shapes. The solid shapes assemble into a self standing cube by itself and the void shapes do likewise. Form variations are assembled ad infinitum with multiple pieces.

In further embodiments of the invention, irreducible shapes may be used to construct larger, multi-dimensional shapes such as cubes, rectangular forms, polygons, etc. In some embodiments of the invention, a significant feature of the structural system is the irreducible solid shape and void shape are the same polyhedral brick shape with dimensions $(L=1)\times(W=L/6)\times(H=L/2)$. In other words, the proportion of the length:width:height is 6:3:1. In other embodiments, the irreducible shape has different proportions such as 5:2.5:1, 15:7.5:1, 2:1:1, 4:2:1, 1:1:1, 3:1.5:1, 6:3:1, 5:2.5:1, 8:4:1, 6:3:1, 10:5:1, 12:6:1, 14:7:1 and so forth. The irreducible shape may not a cube, but a multi-dimensional shape such as a cube may be assembled with it.

The fewest number of individual polyhedral brick shapes required to create a cube may be twelve in some embodiments. In other embodiments of the invention, the number may be higher or lower. For example, a larger cube may be comprised of 96 bricks. Further, in some embodiment there may be two distinct forms required to assemble the interlocking cube. One form may be comprised of six joined opaque polyhedral bricks. Another form may be comprised of six joined clear polyhedral bricks. These forms, both opaque and clear, may be assembled or combined to form a multi-dimensional shape such as a cube.

In one embodiment of the invention, the puzzle comprises a plurality of irreducible polyhedral forms having length L, width L/6, and height L/2. The irreducible polyhedral forms may represent positive structural form and/or negative space, and the two combinations of six polyhedral pieces may form the basis of a unique interlocking structural system of positive and negative space that form a cube and other shapes. Additional combinations of each respective combination may form the basis of additional cube puzzles of lesser degree of difficulty. Additional combinations of the basic forms are infinite.

In an embodiment of the invention, the positive structural forms comprise six bricks, each brick having a length, height, and width dimension. The length dimension can be larger than the height dimension, and the height dimension can be larger than the width dimension. Three of the six bricks may be oriented substantially parallel to each other in the width dimension. The remaining three bricks may be oriented substantially perpendicular to the first three bricks, and the remaining three bricks are disposed below—in the height dimension—the first three bricks. In some embodiments, the number of blocks may vary, and the positive structural forms may exhibit different chirality or handedness.

In certain embodiments, the negative structural forms also comprise six bricks, each brick having a length, height, and width dimension. The length dimension can be larger than the height dimension, and the height dimension can be larger than the width dimension. Three of the six bricks may be oriented substantially parallel to each other in the width dimension. The remaining three bricks may lie in a common plane—in the height dimension—as the first three bricks, but the remaining three bricks may oriented perpendicular to the first three bricks. One of the remaining bricks connects the first three bricks at one longitudinal end of the first three bricks, and the last two of the remaining bricks are disposed on the outer surface of one of the first three bricks. In some embodiments, the number of blocks may vary, and the negative structural forms may exhibit different chirality or handedness. The handedness of the negative structural forms may correspond to the handedness of the positive structural forms, or not. In other words, in various embodiments forms of varying handedness or chirality may be used together.

It will be appreciated that the shape of the positive and negative structural forms described above is not the only form shape of the invention. The forms may be constructed in other polyhedral shapes such as those found in U.S. Pat. No. 5,169,352, which is hereby incorporated by reference in its entirety. Further, the forms may include various curved surfaces such as those found in U.S. Pat. No. 4,011,683, which is hereby incorporated by reference in its entirety.

It is another aspect of embodiments of the invention to provide a base piece or pieces that supports the puzzle as a user is solving the puzzle or otherwise engaging the components of the puzzle. Examples of support bases can be found in U.S. Pat. No. 7,140,612, which is hereby incorporated by reference in its entirety. Some embodiments of the invention may include a support base, or support bases, that has a polygonal bottom member with one or more vertical towers attached to the bottom member. The support bases of the invention may optionally include side walls in contact with the bottom member and in contact with each other. The side walls may be attached to the bottom member of the support base or they may be slidingly removable. The removable side walls may be attached to one another so as to form a sleeve which may be slidingly removed from the support base in either a vertical or horizontal direction. The vertical towers have a shape equivalent to a whole number of cubes of the same dimension as the cubes forming the assembly pieces. Thus, it is an object of the invention to provide support bases comprising a polygonal bottom member, at least two vertical stairstep side walls, and optionally a vertical back wall attached to the two vertical stairstep side walls.

It is an object of some embodiments of the invention to provide support bases comprising a bottom member and a non-rectangular circumferential side wall. In all of the support bases of the invention the bottom members, the circumferential side walls, the vertical side walls, vertical back walls, and the vertical stairstep side walls have a shape divisible into a whole number of squares, where the size of a square is equal to the size of a cube face. While reference to a "cube" is employed throughout this application, it should be understood that other shaped structured can supplant a "cube" and thus, the invention is not limited to any geometric shape.

It is an aspect of embodiments of the invention to provide a puzzle made from a variety of materials for a number of purposes. The puzzle may be made from plastic, wood, metal, stone, mineral, marble, tile, honeycomb, sponge, coral, gemstones, coal, sand, butterfly wings, straw, embroidery, ice, food material, i.e., swiss cheese, paper, cardboard, fabric, brick, polyethylene resin, Plexiglas, ferromagnetic fluids, and any other material known in the art. Materials or combinations of materials may be chosen for many purposes including, but not limited to, durability, luxury, and color. In some embodiments of the invention, components of the puzzle may be made from a 3-D printing process. In some embodiments, different colored individual parts are used to vary the color of the completed structure. In one game scenario, the particular structure's color must be activated through a combination or sequence of combination of the constituent components of the invention.

The chosen material, or materials, may include surfaces with a variety of textures. As mentioned above, some embodiments of the invention comprise two types of polyhedral forms such that a number of polyhedral forms selectively interconnect to form a multi-dimensional shape. The surfaces of these polyhedral forms may be textured in such a way to increase resistance when a user is combining the polyhedral forms in an improper fashion and to decrease resistance when a user is combining the polyhedral forms in a proper fashion. For example, the two types of polyhedral forms may include longitudinal ridges that align and provide decreased resistance when the polyhedral forms are properly aligned. It will be appreciated that textures may be on a variety of surfaces of the polyhedral forms. Further, it will be appreciated that various features and purposes may go beyond aiding a user with the proper combination of forms, for example, a coarse texture may simply aid in holding two forms together as the user completes the puzzle.

It is a further aspect of embodiments of the invention to provide a puzzle where the constituent forms may include surfaces that are not perfectly planar. For example, in one embodiment a form may include a chamfered, radiused, and/or beveled edge. Further, in some embodiments a form may include a notched, crenellated, or saw-toothed edge. These various aspects of the form may be used to provide a greater ease of assembly as the forms are combined together. Or as described elsewhere herein, these edge features may impede assembly when the assembly is "incorrect" or the edge features may impede assembly in one direction. It will be appreciated that a variety of combinations of edges may be formed with and without features where the edges are used for a variety of applications.

The various components of the invention may be colored uniformly or differently. Individual portions of the assembly pieces may be colored differently so as to form an aesthetically pleasing pattern or picture upon puzzle assembly. For example, museum shops could create an embodiment of the invention with historical images on one or more faces of the forms or the completed multi-dimensional shape. In further embodiments, the puzzle is a collectable, limited edition, or commemorative edition. The components of the invention may be assembled into a multi-dimensional party favor. Numbers may be placed on the cube-portion faces to form particular numeric totals vertically, horizontally, and diagonally upon puzzle assembly. It is a further object of the invention to provide packaging and written directions for use of puzzles of the invention. The positive form mentioned above may be an opaque color while the negative form mentioned above may be transparent or translucent in appearance.

In various embodiments, letters may be printed on the outer surface of the forms, or inner surfaces of the forms, to aid a user in learning a language. For example, one embodiment may simply have one letter per form, and a child assembles the puzzle while learning the letters of an alphabet. In more complex examples, the forms of a multi-dimensional puzzle help a user learn grammar or sentence structure. It will be appreciated that embodiments may utilize any language, including dead languages.

In embodiments of the invention, various symbols may be used for educational purposes such as religious studies or biology. In one embodiment, a form comprises a picture of an animal of a particular gender, and a corresponding form comprises a picture of the same animal with the opposite gender. The user assembles pairs of animals just as Noah did on Noah's Ark. In a biological context, the forms may comprise various aspects of a species such as kingdom, phylum, class, order, family, tribe, and genus in order to teach a user about this particular classification scheme. It will be appreciated that other subjects may be taught using embodiments of the invention.

In some embodiments, the components of the puzzle are partially or totally transparent or translucent. The interior structure, so important to the solution of a three-dimensional puzzle, is not apparent in an opaque puzzle. In most transparent puzzles, the interior structure, although visible, is incidental to the assembled puzzle. There are puzzles consisting of pieces, which are extrusions of two-dimensional forms, or layers of such extrusions, such as "double decker" pieces. These pieces consist of two extruded two-dimensional pieces layered one on another and bound to create a single piece. These types of pieces are incidental to the form of the assembled puzzle.

It will be appreciated that the color may serve other purposes beyond aesthetics or binary logic. For example, color-coding the various components of the puzzle may serve children who easily associate colors with different concepts, for example red may be equated with danger. Further, the color-coding may become part of the puzzle itself. For example, certain color blocks may not be allowed to touch each other or certain color block must touch each other, etc.

It is an aspect of embodiments of the invention to provide symbols on the surfaces of the puzzle and its components. Symbols include, but are not limited to, Arabic numerals, Roman numerals, and pictures. These symbols may be disposed on various surfaces of the puzzle and/or its components for a variety of purposes. For example, numbers disposed on the exterior surface may form a Sudoku-like game such as the one described in U.S. Pat. No. 7,644,924, which is hereby incorporated by reference in its entirety. In other embodiments of the invention, the symbols may be language with instructions on how to utilize or solve the puzzle.

It is a further aspect of embodiments of the invention to provide puzzles that incorporate electronics into the utility of the puzzle. For example, electrodes disposed in a form could interact, wired or wirelessly, with an electrode disposed in another form and enhance the experience of the user. As the user assembles the puzzle, it could produce various sounds at various times such as music upon the completion of the puzzle. The right sequence of solving the puzzle could produce a harmony, chorus, or other sonic signal to the user. Further, a sonic countdown may be incorporated into embodiments of the invention such that a user races to assemble, disassemble, or engage the puzzle before the countdown is complete. Such a sonic countdown may include a ticking time bomb sound. It will be appreciated that other sonic signals may influence the temporal nature of the puzzle being solved or game being played. Further, it will be appreciated that sound cancelling may be an aspect of the invention. For example, the forms of the invention may be made of sound-proofing material and assembled on the walls of a room to provide sound-dampening capabilities.

It is a further aspect of embodiments of the invention to provide a luminal component to the puzzle for gaming or other purposes. Similar to the sonic signals described above, a particular sequence of assembly, disassembly, or other engagement of the puzzle may produce different colors, combinations of colors, intensities of light, or any other feature of light. The light produced by the puzzle may be incorporated into various games. Using the ticking time bomb example from above, the puzzle may pulse red to signal danger, and the frequency of the pulse may increase as the timer counts down. It will be appreciated that common devices may be used to produce light including, but not limited to, light-emitting diodes, LASERs, incandescent bulbs, and fluorescent lamps.

Incorporating static or dynamic colors into the invention can serve various purposes. In some embodiments of the invention, the color may be static and be part of a game as described elsewhere herein. In some embodiments, some or all of the components of the puzzle may glow in the dark. Further yet, different colored components of the puzzle may combine to produce additional colors. For example, a red form and a blue form may exhibit a purple color when combined. In another example, the pieces may remain dark but light up after a particular sequence of assembly, disassembly, or other engagement of the puzzle. This may serve as a night light, a signaling device in an emergency, or simply a signal that the user has completed the puzzle.

In yet another embodiment, the static or dynamic lighting may be combined with sonic aspects of the invention. In some embodiments, as components of the puzzle are combined and produce a sonic signal, the components may also produce a corresponding luminal signal. In one embodiment, a sequence or combination of component may produce a sonic signal that is in a particular musical key. The components may also produce a color or shade of light that corresponds to that particular key. Thus, as a user engages the invention and associates different keys with different colors, he or she may develop a better ear for detecting musical pitch.

Further yet, properties of the material or materials chosen may be combined with electronics, and sonic or luminal signals. In one embodiment of the invention, electronics produce a magnetic field, which stimulates a ferromagnetic fluid into a semi-solid shape. As a user attempts to assemble a plurality of these shapes, a sonic or luminal signal may indicate a countdown timer for the user to solve the puzzle. If the user fails to solve the puzzle before the countdown timer expires, then the magnetic field is disabled, and the ferromagnetic forms dissolve away. It will be appreciated that other material properties may be in combination with other sensorial inputs and aspects of the invention described elsewhere herein. In some embodiments, parts repel each other, in others, they attract so that some structures have magnetic voids created within the structure.

It is an aspect of embodiments of the invention to provide puzzles and forms of various sizes. The puzzle and the forms may simply be scaled to a larger or small size. However, it will be appreciated that the size of the forms may play a role in the invention itself. For example, smaller forms may combine to form a shape such as a cube or rectangle, then that completed shape serves as a form or component of a larger puzzle. Further, the size of the invention may be reduced to the atomic or sub-atomic scale where each form may be comprised of a few atoms. At the micro scale, the forms may be on the order of 1 μm to 1 mm, and at a larger scale, on the order of 1 cm to 1 inch or 2 ft. At an intermediate scale, the forms may be held in the user's hand. And at larger scales, the forms may be the size of a person and require the use of a crane to assemble the puzzle. At even larger scales, the forms may be so large that they must be combined or otherwise utilized in space. The variable scales can engender variable natural phenomena. For example, at the smallest scales, the viscosity of air or fluid may dominate, or at larger scales, the invention may enjoy the benefits of fin effects and air current flowing through. It will be appreciated that a variety of physical phenomena may be employed by the invention to enjoy benefits.

It is an aspect of embodiments of the invention to provide a puzzle that exists in a virtual world. The invention described herein may be implemented in a computer-generated world. This allows embodiments of the invention to achieve a scale and flexibility that is not possible in the physical world. Further, the games described herein may include a reward and/or point system. For example, in one embodiment of the invention, the user acquires a number of points upon completion of a puzzle. The user may also use embodiments of the invention in a free form world with no points and no objective. Implementation of this aspect of the invention may be similar to those described in U.S. Patent Publication No. 2013/0316832, U.S. Patent Publication No. 2010/0227675, and U.S. Pat. No. 8,272,956, the entireties of which are hereby incorporated by reference.

In other embodiments of the invention, the components of the puzzle may be combined with additional components to form games or toys for children. For example, components such as a roof, a wheel, a windshield, etc. may be produced to selectively interconnect to the ordinary puzzle components to produce a system of components for a game or toy. For example, a system for toy bricks is described in U.S. Pat. No. 3,005,282, which is hereby incorporated by reference in its entirety, and an ad hoc piece for the system is described in Design Pat. No. D689,558, which is hereby incorporated by reference in its entirety.

It is an aspect of certain embodiments of the invention to provide a puzzle that serves a purpose beyond toys and games. In one embodiment, the components of the puzzle are a modular system that may assemble to construct a variety of objects. For example, the components of the invention may be constructed to form a chair or a couch, but when the chair or couch is not longer immediately required, the components may be combined into a multi-dimensional shape such as a cube and simply stored away. Other applications include, but are not limited to, tables, chairs, side tables, night stands, skyscrapers, and benches. It will be appreciated that a variety of applications of this modular concept to objects and devices may be constantly in use and would benefit from a more compact storage.

It is another aspect of various embodiments of the invention to provide a puzzle that serves to create works of art. Other embodiments described herein generally relate to a purpose with straight forward utility, but embodiments of the invention include puzzles and/or its modular forms that can be used to create mandalas, sculptures, masks, temples, and other multi-dimensional artistic expressions. The artistic use of the invention may be organized into juried competitions with best-of-show prizes and other prizes. The same applies to juried architectural contests.

In some embodiments, the puzzles can be expanded to the next cube level (8×96 bricks) with all the solid pieces (6 joined bricks per piece) being the same. The void or clear pieces become much more complex to make it all interlocking. This, of course is expandable in all directions ad infinitum. Further, any sculptural 3D shape (animal, vegetable, mineral) can be carved out of a mass of interconnecting parts, not just carved out of a cube, but any form composed of the interlocking parts. Bricks and joined pieces can be distorted with different algorithms into all kinds of curved shapes and then carved into any sculptural 3D shape. These can either assemble and disassemble or be glued together permanently. The The individual solid bricks, joined into a variety of "pieces", leaving the void bricks vacant, create a lattice structure that may have multiple uses: Heating and cooling elements, filters, printed circuits, bone and tissue grafting armatures. In other embodiments, the invention may be a security device where a user has to assemble or disassemble a puzzle in a proper order to access a void in the center of the puzzle.

The fundamental brick shape, hollow, pervious, or impervious mimics the shape of plant cellular structure. As in nature where the cellular structure of plants has given rise to countless beautiful and functional forms, so too, the manufactured brick shape in the hands of mankind has been formed into dwellings, cities, art and wonders of engineering. Use of the brick as a cellular form is entering a renaissance in art, architecture and engineering from micro circuitry to skyscrapers.

One particular embodiment of the invention is a multi-dimensional spatial assembly, comprising a first planar form having a first plurality of protrusions oriented in a first direction, the first planar form having a second plurality of protrusions oriented in a second direction, wherein the first and second pluralities of protrusions lie in a common plane, and wherein the first direction is perpendicular to the second direction; a first non-planar form having a third plurality of protrusions oriented in the first direction, the first non-planar form having a fourth plurality of protrusions oriented in the second direction, wherein the third and fourth pluralities of protrusions do not lie in a common plane; and wherein the first plurality of protrusions of the first planar form are selectively received in recesses between protrusions of the third plurality of protrusions of the first non-planar form.

Other embodiments may comprise a second non-planar form having a fifth plurality of protrusions oriented in the second direction, the second non-planar form having a sixth plurality of protrusions oriented in the first direction, wherein the fifth and sixth pluralities of protrusions do not lie in a common plane; wherein some of the second plurality of protrusions of the first planar form are selectively received in recesses between protrusions of the fifth plurality of protrusions of the second non-planar form.

Other embodiments may comprise a third non-planar form having a seventh plurality of protrusions oriented in the second direction, the third non-planar form having an eighth plurality of protrusions oriented in the first direction, wherein the seventh and eighth pluralities of protrusions do not lie in a common plane; wherein some of the second plurality of protrusions of the first planar form are selectively received in recesses between protrusions of the seventh plurality of protrusions of the third non-planar form.

Other embodiments may comprise a fourth non-planar form having a ninth plurality of protrusions oriented in the first direction, the fourth non-planar form having a tenth plurality of protrusions oriented in the second direction, wherein the ninth and tenth pluralities of protrusions do not lie in a common plane; a second planar form having an eleventh plurality of protrusions oriented in the first direction, the second planar form having a twelfth plurality of protrusions oriented in the second direction, wherein the eleventh and twelfth pluralities of protrusions lie in a common plane; wherein the eleventh plurality of protrusions of the second planar form are selectively received in recesses between protrusions of the ninth plurality of protrusions of the fourth non-planar form, wherein some of the twelfth plurality of protrusions of the second planar form are selectively received in recesses between protrusions of the fifth plurality of protrusions of the second non-planar form, and wherein some of the twelfth plurality of protrusions of the second planar form are selectively received in recesses between protrusions of the seventh plurality of protrusions of the third non-planar form.

Other embodiments may comprise eight planar bodies and eight non-planar bodies selectively interconnect with each other to form at least one of a cube, a rectangular prism, a triangular prism, a rectangular pyramid, a triangular pyramid, a cylinder, a cone, and a sphere. Other embodiments may comprise wherein the first plurality of protrusions is three protrusions, wherein the second plurality of protrusions is three protrusions, the third plurality of protrusions is three protrusions, and the fourth plurality of protrusions is three protrusions. Other embodiments may comprise wherein the protrusions of the first plurality of protrusions have a length, a height, and a width. Other embodiments may comprise wherein the height is approximately 50% of the length, the width is approximately 17% of the length. Other embodiments may comprise wherein the first planar form comprises a first opacity, and the first non-planar form comprises a second opacity, wherein the first opacity is different than the second opacity. Other embodiments may comprise wherein at least one of the first planar form and the first non-planar form comprises a lumination source. Other embodiments may comprise wherein at least one of the first planar form and the first non-planar form comprises an audible source.

Another particular embodiment of the invention is a method of assembling a multi-dimensional spatial assembly, comprising providing a first planar form having a first plurality of protrusions oriented in a first direction, the first planar form having a second plurality of protrusions oriented in a second direction, wherein the first and second pluralities of protrusions lie in a common plane, and wherein the first direction is perpendicular to the second direction; providing a first non-planar form having a third plurality of protrusions oriented in the first direction, the first non-planar form having a fourth plurality of protrusions oriented in the second direction, wherein the third and fourth pluralities of protrusions do not lie in a common plane; and receiving, selectively, the first plurality of protrusions of the first planar form in recesses between protrusions of the third plurality of protrusions of the first non-planar form.

Other embodiments may comprise providing a second non-planar form having a fifth plurality of protrusions oriented in the second direction, the second non-planar form having a sixth plurality of protrusions oriented in the first direction, wherein the fifth and sixth pluralities of protrusions do not lie in a common plane; and receiving, selectively, some of the second plurality of protrusions of the first planar form in recesses between protrusions of the fifth plurality of protrusions of the second non-planar form.

Other embodiments may comprise providing a third non-planar form having a seventh plurality of protrusions oriented in the second direction, the third non-planar form having an eighth plurality of protrusions oriented in the first direction, wherein the seventh and eighth pluralities of protrusions do not lie in a common plane; and receiving, selectively, some of the second plurality of protrusions of the first planar form in recesses between protrusions of the seventh plurality of protrusions of the third non-planar form.

Other embodiments may comprise providing a fourth non-planar form having a ninth plurality of protrusions oriented in the first direction, the fourth non-planar form having a tenth plurality of protrusions oriented in the second direction, wherein the ninth and tenth pluralities of protrusions do not lie in a common plane; providing a second planar form having an eleventh plurality of protrusions oriented in the first direction, the second planar form having a twelfth plurality of protrusions oriented in the second direction, wherein the eleventh and twelfth pluralities of protrusions lie in a common plane; receiving, selectively, the eleventh plurality of protrusions of the second planar form in recesses between protrusions of the ninth plurality of protrusions of the fourth non-planar form; receiving, selectively, some of the twelfth plurality of protrusions of the second planar form in recesses between protrusions of the fifth plurality of protrusions of the second non-planar form; and receiving, selectively, some of the twelfth plurality of protrusions of the second planar form in recesses between protrusions of the seventh plurality of protrusions of the third non-planar form.

Other embodiments may comprise interconnecting, selectively, eight planar bodies and eight non-planar bodies to form at least one of a cube, a rectangular prism, a triangular prism, a rectangular pyramid, a triangular pyramid, a cylinder, a cone, and a sphere. Other embodiments may comprise wherein the first plurality of protrusions is three protrusions, wherein the second plurality of protrusions is three protrusions, the third plurality of protrusions is three protrusions, and the fourth plurality of protrusions is three protrusions. Other embodiments may comprise wherein the protrusions of the first plurality of protrusions has a length, a height, and a width, and wherein the height is approximately 50% of the length, the width is approximately 17% of the length. Other embodiments may comprise wherein at least one of the first planar form and the first non-planar form comprises a lumination source, and wherein at least one of the first planar form and the first non-planar form comprises an audible source.

Yet another particular embodiment of the invention is a multi-dimensional spatial assembly, comprising a first planar form having a first plurality of protrusions oriented in a first direction, the first planar form having a second plurality of protrusions oriented in a second direction, wherein the first and second pluralities of protrusions lie in a common plane, and wherein the first direction is perpendicular to the second direction; a first non-planar form having a third plurality of protrusions oriented in the first direction, the first non-planar form having a fourth plurality of protrusions oriented in the second direction, wherein the third and fourth pluralities of protrusions do not lie in a common plane, wherein the first plurality of protrusions of the first planar form are selectively received in recesses between protrusions of the third plurality of protrusions of the first non-planar form; a second non-planar form having a fifth plurality of protrusions oriented in the second direction, the second non-planar form having a sixth plurality of protrusions oriented in the first direction, wherein the fifth and sixth pluralities of protrusions do not lie in a common plane, wherein some of the second plurality of protrusions of the first planar form are selectively received in recesses between protrusions of the fifth plurality of protrusions of the second non-planar form; a third non-planar form having a seventh plurality of protrusions oriented in the second direction, the third non-planar form having an eighth plurality of protrusions oriented in the first direction, wherein the seventh and eighth pluralities of protrusions do not lie in a common plane, wherein some of the second plurality of protrusions of the first planar form are selectively received in recesses between protrusions of the seventh plurality of protrusions of the third non-planar form; a fourth non-planar form having a ninth plurality of protrusions oriented in the first direction, the fourth non-planar form having a tenth plurality of protrusions oriented in the second direction, wherein the ninth and tenth pluralities of protrusions do not lie in a common plane; a second planar form having an eleventh plurality of protrusions oriented in the first direction, the second planar form having a twelfth plurality of protrusions oriented in the second direction, wherein the eleventh and twelfth pluralities of protrusions lie in a common plane; and wherein the eleventh plurality of protrusions of the second planar form are selectively received in recesses between protrusions of the ninth plurality of protrusions of the fourth non-planar form, wherein some of the twelfth plurality of protrusions of the second planar form are selectively received in recesses between protrusions of the fifth plurality of protrusions of the second non-planar form, wherein some of the twelfth plurality of protrusions of the second planar form are selectively received in recesses between protrusions of the seventh plurality of protrusions of the third non-planar form; wherein the protrusions of the various pluralities of protrusions have a length, a height, and a width, wherein the height is approximately 50% of the length, the width is approximately 17% of the length.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

Other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings are incorporated into and form a part of the specification to illustrate several examples of the invention(s). These drawings, together with the description, explain the principles of the invention(s). The drawings simply illustrate preferred and alternative examples of how the invention(s) can be made and used and are not to be construed as limiting the invention(s) to the illustrated and described below.

DETAILED DESCRIPTION

As described in detail below, various embodiments of the invention include a multi-dimensional puzzle. The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

Figure 1A:
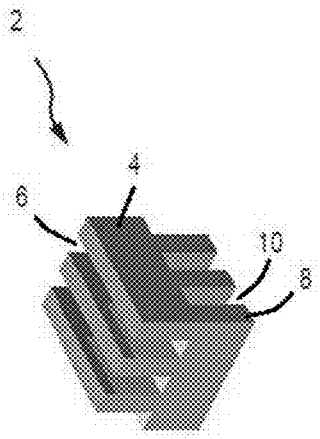
FIGS. 1A-1B depict a non-planar form according to embodiments of the invention.
Figure 2A:
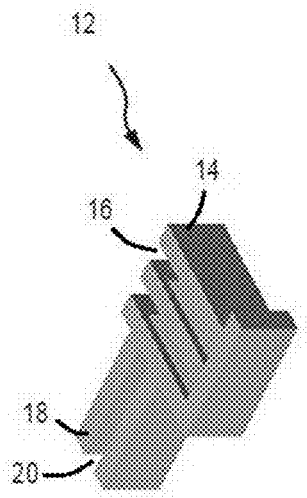
FIGS. 2A-2B depict a planar form according to embodiments of the invention.
Figure 1B:
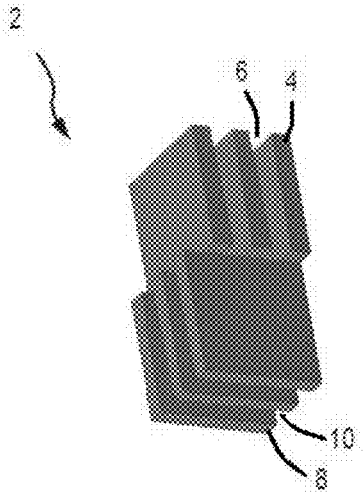
Figure 2B:
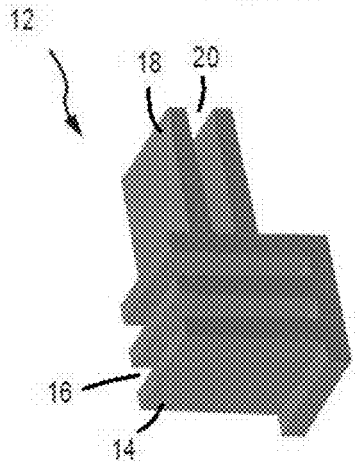

FIGS. 1A and 1B depict non-planar forms 2, and FIGS. 2A and 2B depict planar forms 12. The non-planar form 2 of FIG. 1A and the planar form 12 of FIG. 2A may combine to form a spatial assembly according to one embodiment of the invention. Further, the non-planar form 2 of FIG. 1B and the planar form 12 of FIG. 2B may combine to form a spatial assembly according to another embodiment of the invention.

The non-planar forms of FIGS. 1A and 1B have a plurality of protrusions 4, three protrusions in this embodiment, extending in a first direction wherein at least one recess 6 is disposed between the protrusions 4. Another plurality of protrusions 8, three protrusions in this embodiment, extends in a second direction wherein at least one recess 10 is disposed between the protrusions 8. The first and second directions are perpendicular, and the two pluralities of protrusions 4, 8 lie in different planes, i.e., the two pluralities of protrusions 4, 8 do not lie in a common plane.

The planar forms of FIGS. 2A and 2B also have a plurality of protrusions 14, three protrusions in this embodiment, extending in a first direction wherein at least one recess 16 is disposed between the protrusions 14. A second plurality of protrusions 18, three protrusions in this embodiment, extends in a second direction wherein at least one recess 20 is disposed between the protrusions 18. In addition, the protrusions of the second plurality of protrusions 18 do not lie adjacent to one another. As depicted in FIGS. 2A and 2B, two protrusions lie on one side of the first plurality of protrusions 14, and one protrusion lies on the other side of the first plurality of protrusions 14. The first and second directions are perpendicular, and the two pluralities of protrusions 14, 18 lie in a common plane.

The protrusions 4, 8, 14, 18 of the forms 2, 12 in FIGS. 1A and 2A have the same dimensions. The protrusions 4, 8, 14, 18 have an overall length L, a height H which is smaller than length L, and a width W which is smaller than height H. In the embodiments in FIGS. 1A and 2A, the height H is L/2, and the width W is L/6. Similarly, the protrusions 4, 8, 14, 18 in FIGS. 1B and 2B have the same dimensions. The protrusions 4, 8, 14, 18 have an overall length L, a height H which is equal to length L, and a width W that is smaller than length L and height H. In this embodiment, width W is L/6, or alternatively H/6. It will be appreciated that the relative sizing between L, H, and W may be any combination discussed elsewhere herein.

Figures 3A, 3B, 3C:
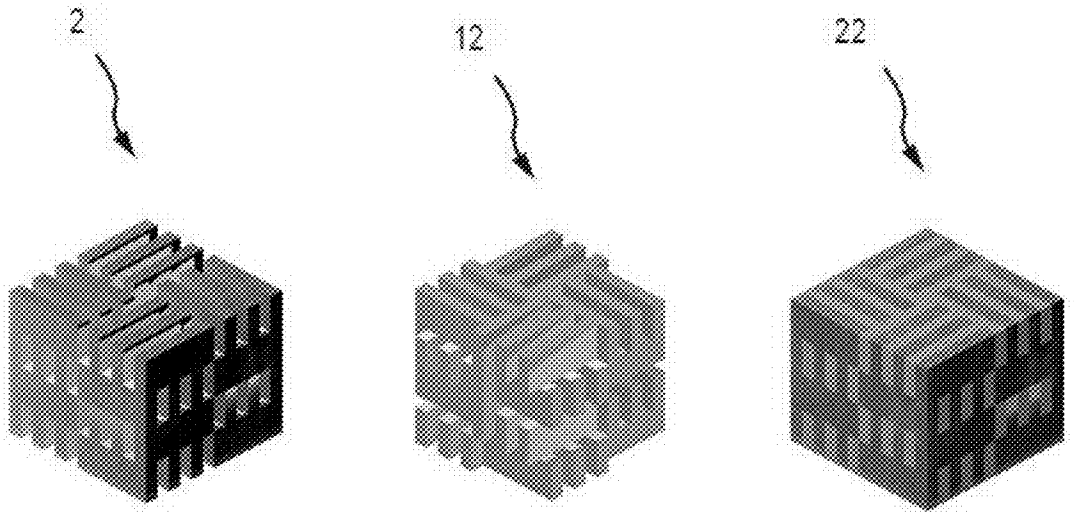
FIGS. 3A-3C depict various stages of assembling non-planar forms and planar forms into a cube spatial assembly according to embodiments of the invention.

FIGS. 3A-3C, show the various stages of creating a spatial assembly from non-planar forms and planar forms. FIG. 3A shows an assembly of eight non-planar forms 2. The four non-planar forms 2 on top have alternating orientations. Similarly, the four non-planar forms 2 on bottom also have alternating orientations. FIG. 3B shows an assembly of eight planar forms 12. The four planar forms 12 on top have alternating orientations. Similarly, the four planar forms 12 on bottom also have alternating orientations.

FIG. 3C shows the eight non-planar forms 2 and the eight planar forms 12 assembled into a spatial assembly 22, which in this embodiment is a cube. FIG. 3C also shows that the non-planar forms 2 and the planar forms 12 may be comprised of different materials or materials with different opacities. One of the forms 2, 12 may represent negative space, and the other form 2, 12 may represent positive space.

Figure 4:
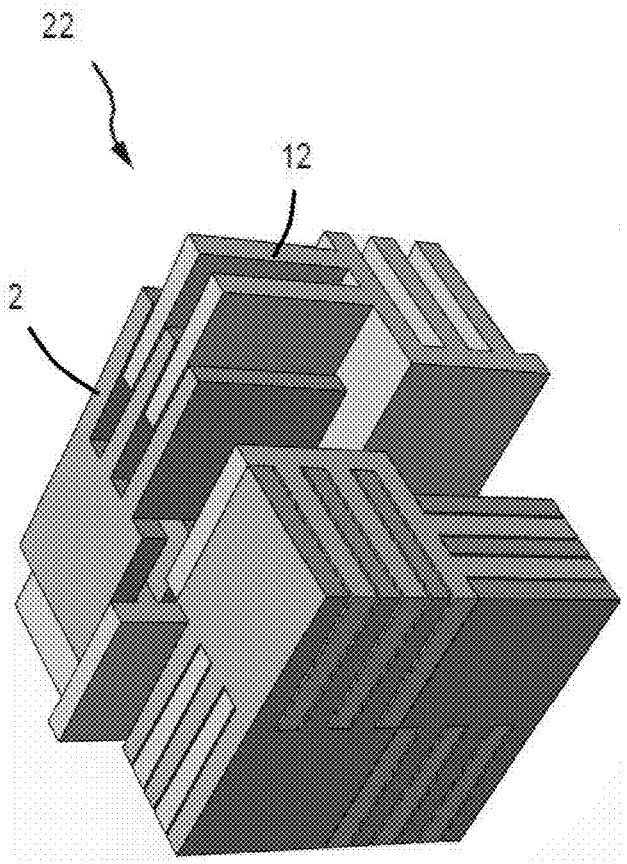
FIG. 4 depicts a partially assembled spatial assembly according to embodiments of the invention.

FIG. 4 shows one stage of assembling the spatial assembly 22 wherein all of the forms 2, 12 are only partially interconnected, and thus, how the forms 2, 12 selectively interconnect with one another. As shown, the protrusions of a planar form 12 slide into the recesses of a non-planar form 2, and vice versa. In this embodiment, all of the non-planar forms 2 are interconnected to each other to create a composite form.

Figure 5:
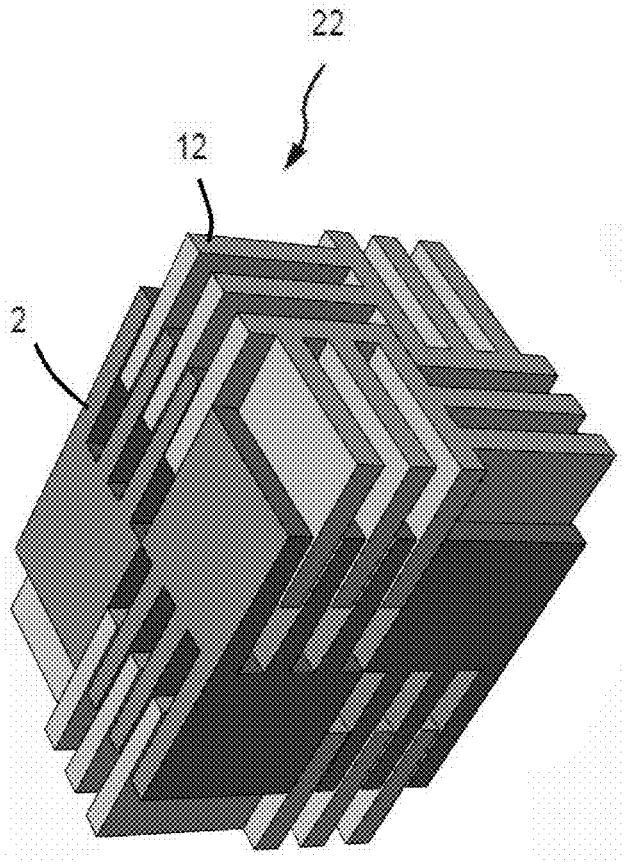
FIG. 5 depicts a partially assembled spatial assembly according to embodiments of the invention.

FIG. 5 shows a later stage of assembling the spatial assembly 22 wherein half of the spatial assembly 22 is assembled such that the non-planar forms 2 are interconnected and wherein the planar forms 12 are in the process of selectively interconnecting to the non-planar forms 2.

Figure 6:
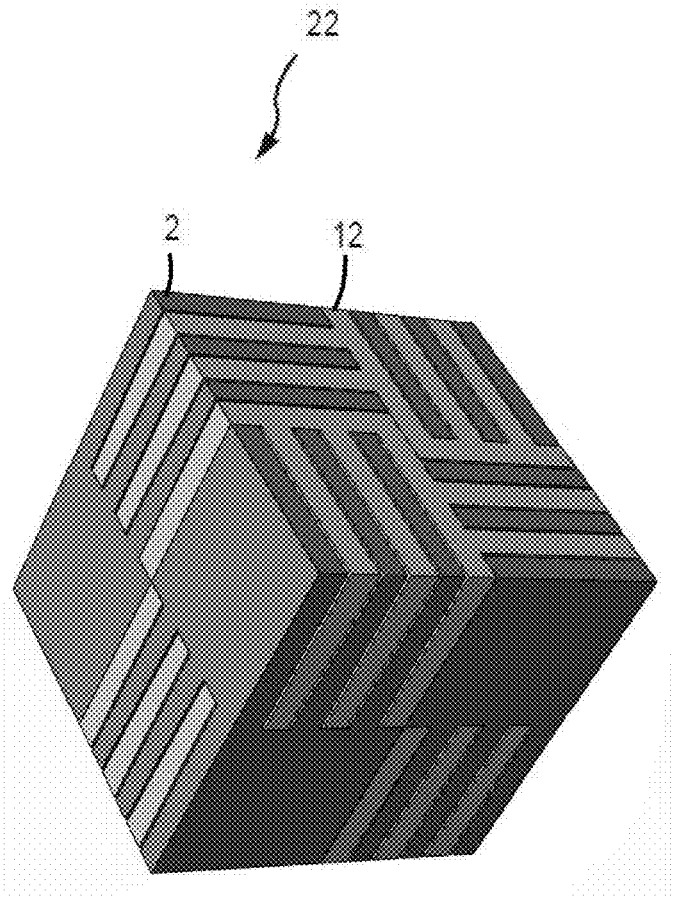
FIG. 6 depicts a fully assembled spatial assembly according to embodiments of the invention.

FIG. 6 shows the spatial assembly 22 completely assembled. Once the stages of assembly as depicted by FIGS. 4 and 5 are successfully completed, the forms 2, 12 create a spatial assembly 22. As shown, the protrusions and recesses of the planar forms 12 are selectively interconnected with the recesses and the protrusions of the non-planar forms 2 such that there is no space between the two forms.

Figure 7C:
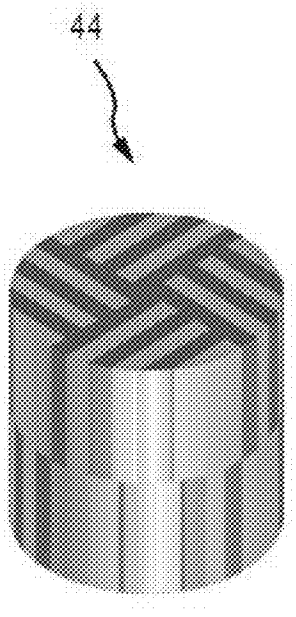
FIG. 7C depicts a completed cylindrical spatial assembly according to embodiments of the invention.
Figure 7B:
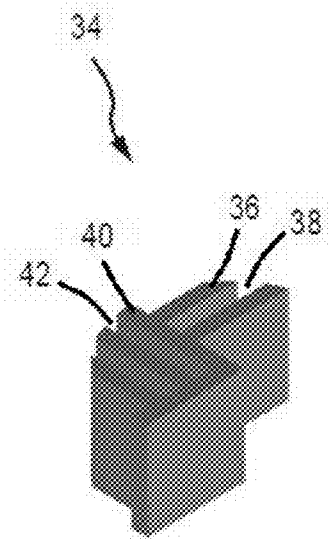
FIG. 7B depicts a planar form according to embodiments of the invention.
Figure 7A:
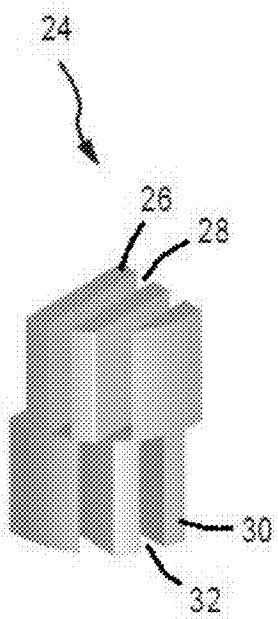
FIG. 7A depicts a non-planar form according to embodiments of the invention.

FIGS. 7A-7C show an embodiment of the invention where the forms comprise protrusions of differing shapes and lengths such that planar and non-planar forms assemble to create a cylindrical spatial assembly 44. The non-planar form 24 of FIG. 7A has a plurality of protrusions 26, three protrusions in this embodiment, extending in a first direction wherein at least one recess 28 is disposed between the protrusions 26. Another plurality of protrusions 30, three protrusions in this embodiment, extends in a second direction wherein at least one recess 32 is disposed between the protrusions 30. The first and second directions are perpendicular, and the two pluralities of protrusions 26, 30 lie in different planes, i.e., the two pluralities of protrusions 26, 30 do not lie in a common plane.

The planar form 34 of FIG. 7B also has a plurality of protrusions 40, three protrusions in this embodiment, extending in a first direction wherein at least one recess 42 is disposed between the protrusions 40. A second plurality of protrusions 36, three protrusions in this embodiment, extends in a second direction wherein at least one recess 38 is disposed between the protrusions 36. In addition, the protrusions of the second plurality of protrusions 36 do not lie adjacent to one another. As depicted in FIG. 7B, two protrusions lie on one side of the first plurality of protrusions 40, and one protrusion lies on the other side of the first plurality of protrusions 40. The first and second directions are perpendicular, and the two pluralities of protrusions 36, 40 lie in a common plane. Eight planar forms 34 and eight non-planar forms 24 combine to form the cylindrical spatial assembly 44 shown in FIG. 7C.

Figures 8A, 8B, 8C:
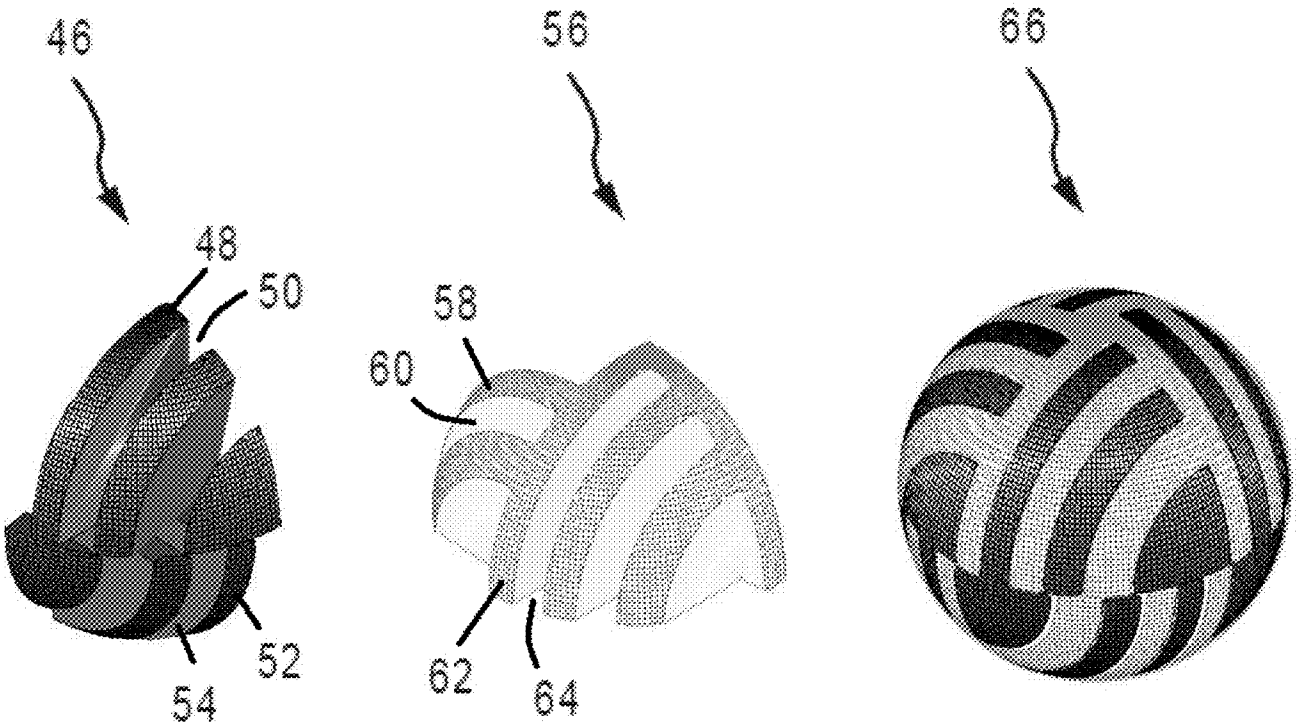
FIG. 8A depicts a non-planar form according to embodiments of the invention.
FIG. 8B depicts a planar form according to embodiments of the invention.
FIG. 8C depicts a completed spherical spatial assembly according to embodiments of the invention.

FIGS. 8A-8C show an embodiment of the invention where the forms comprise protrusions of differing shapes and lengths such that planar and non-planar forms assemble to create a spherical spatial assembly 66. The non-planar form 46 of FIG. 8A has a plurality of protrusions 48, three protrusions in this embodiment, extending in a first direction wherein at least one recess 50 is disposed between the protrusions 48. Another plurality of protrusions 52, three protrusions in this embodiment, extends in a second direction wherein at least one recess 54 is disposed between the protrusions 52. The first and second directions are perpendicular, and the two pluralities of protrusions 48, 52 lie in different planes, i.e., the two pluralities of protrusions 48, 52 do not lie in a common plane.

The planar form 56 of FIG. 8B also has a plurality of protrusions 62, three protrusions in this embodiment, extending in a first direction wherein at least one recess 64 is disposed between the protrusions 62. A second plurality of protrusions 58, three protrusions in this embodiment, extends in a second direction wherein at least one recess 60 is disposed between the protrusions 58. In addition, the protrusions of the second plurality of protrusions 58 do not lie adjacent to one another. As depicted in FIG. 8B, two protrusions lie on one side of the first plurality of protrusions 62, and one protrusion lies on the other side of the first plurality of protrusions 62. The first and second directions are perpendicular, and the two pluralities of protrusions 58, 62 lie in a common plane. Eight planar forms 56 and eight non-planar forms 46 combine to form the cylindrical spatial assembly 66 shown in FIG. 8C.

Figure 9B:
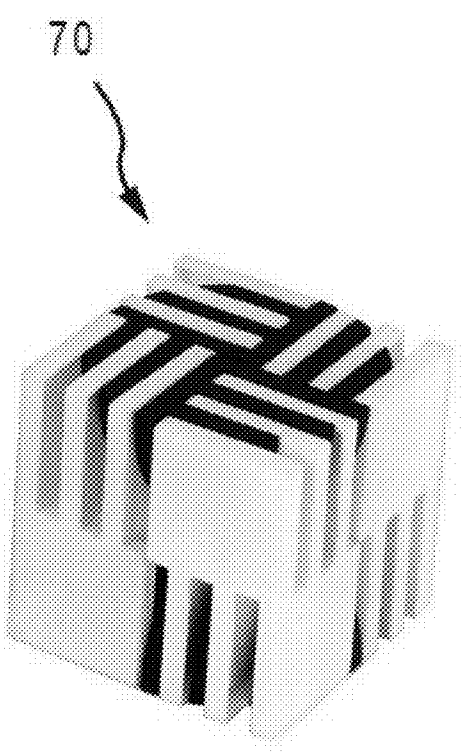
FIGS. 9A-9C depict mixed spatial assemblies comprised of different planar forms and non-planar forms according to embodiments of the invention.
Figure 9A:
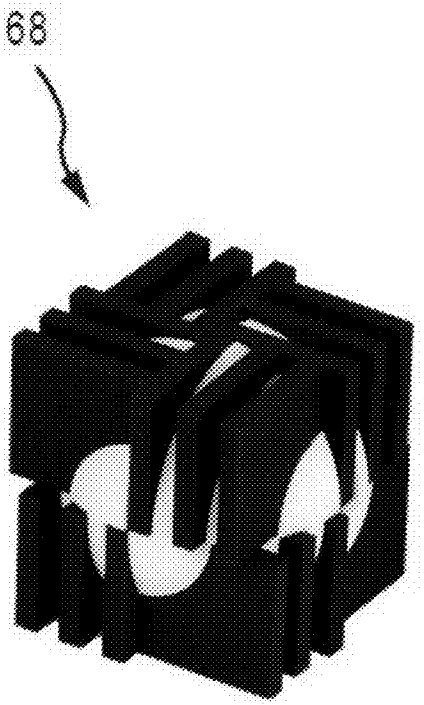
Figure 9C:
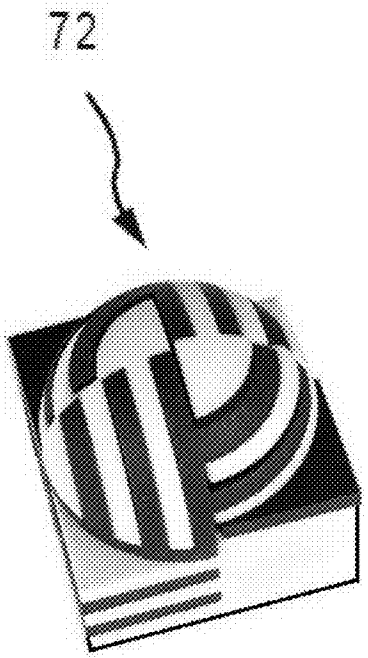

FIGS. 9A-9C show various combinations of different types of planar and non-planar forms. FIG. 9A shows a mixed spatial assembly 68 that combines non-planar forms for a spherical spatial assembly with planar forms for a cube spatial assembly. FIG. 9B shows a mixed spatial assembly 70 that combines non-planar forms for a cube assembly with planar forms for a spherical assembly. FIG. 9C shows a mixed spatial assembly 72 where half of the spatial assembly is a sphere and the other half of the spatial assembly is a cube. It will be appreciated that any combination planar forms, non-planar forms, or any other type of forms may be used to create any number of shapes or structures.

In this specification, the phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A multi-dimensional spatial assembly, comprising: a cube structure comprising eight reversibly detachable pieces, with four of a first set of said eight pieces being identical to each other and with four of a second set of said eight pieces being identical to each other, said first set comprising pieces having only two substantially planar protrusions oriented in a first direction and only three substantially planar protrusions oriented in a second direction, and wherein said second set comprises pieces having only three substantially planar protrusions oriented in said first direction and only three substantially planar protrusions oriented in said second direction, wherein said first direction is perpendicular to said second direction; and wherein said substantially planar protrusions are adapted to be selectively received in recesses between said substantially planar protrusions and wherein said substantially planar protrusions of said first set and said second set are identical in length, height, and width.

2. The assembly as set forth in claim 1, wherein said first set and second set have different opacities.

3. The assembly as set forth in claim 1, wherein said height is approximately 50% of said length.

4. The assembly as set forth in claim 1, wherein said width is approximately 17% of said length.

5. The assembly as set forth in claim 1, wherein at least one of said first set and second set comprises a lumination source.

6. The assembly as set forth in claim 1, wherein at least one of said first set and second set comprises an audible source.

7. The assembly as set forth in claim 1, wherein said pieces are constructed of plastic.

8. The assembly as set forth in claim 1, wherein the first set is transparent.

9. The assembly as set forth in claim 1, wherein the first set comprises glow in the dark material.

10. The assembly as set forth in claim 1, wherein said first set is the color red and the second set is the color blue.

11. The assembly as set forth in claim 1, wherein said cube is sized to fit in a human hand.

12. A method of assembling a multi-dimensional spatial assembly, comprising: providing eight reversibly detachable pieces, with four of a first set of said eight pieces being identical to each other and with four of a second set of said eight pieces being identical to each other, said first set comprising pieces having only two substantially planar protrusions oriented in a first direction and only three substantially planar protrusions oriented in a second direction, and wherein said second set comprises pieces having only three substantially planar protrusions oriented in said first direction and only three substantially planar protrusions oriented in said second direction, wherein said first direction is perpendicular to said second direction; and wherein said substantially planar protrusions are adapted to be selectively received in recesses between said substantially planar protrusions and wherein said substantially planar protrusions of said first set and said second set are identical in length, height, and width;

receiving, selectively, substantially planar protrusions of said first set of pieces in said recesses between substantially planar protrusions of said second set of pieces; and forming a cube structure by connecting all of said eight reversibly detachable pieces.

13. A multi-dimensional spatial assembly, comprising: a cube structure comprising eight reversibly detachable pieces, with four of a first set of said eight pieces being identical to each other and with four of a second set of said eight pieces being identical to each other, said first set comprising pieces having only two substantially planar protrusions oriented in a first direction and only three substantially planar protrusions oriented in a second direction, and wherein said second set comprises pieces having only three substantially planar protrusions oriented in said first direction and only three substantially planar protrusions oriented in said second direction, wherein said first direction is perpendicular to said second direction; and wherein said substantially planar protrusions are adapted to be selectively received in recesses between said substantially planar protrusions and wherein said substantially planar protrusions of said first set and said second set are identical in length, height, and width, said height being approximately 50% of said length, and said width being approximately 17% of said length.

14. The assembly as set forth in claim 8, wherein at least one of said first set and second set comprises a lumination source.

15. The assembly as set forth in claim 8, wherein at least one of said first set and second set comprises an audible source.

16. The assembly as set forth in claim 13, wherein said pieces are constructed of plastic.

17. The assembly as set forth in claim 13, wherein the first set is transparent.

18. The assembly as set forth in claim 13, wherein the first set comprises glow in the dark material.

19. The assembly as set forth in claim 13, wherein said first set is the color red and the second set is the color blue.

20. The assembly as set forth in claim 13, wherein said cube is sized to fit in a human hand.

* * * * *